166-308 SR
11/9/76 XR 3,990,512

United States Patent [19]
Kuris

[11] 3,990,512
[45] Nov. 9, 1976

[54] METHOD AND SYSTEM FOR ULTRASONIC OIL RECOVERY

[75] Inventor: Arthur Kuris, Riverdale, N.Y.

[73] Assignee: Ultrasonic Energy Corporation, Riverdale, N.Y.

[22] Filed: July 10, 1975

[21] Appl. No.: 594,663

[52] U.S. Cl. ..... 166/249; 166/299; 166/308; 166/63; 166/177
[51] Int. Cl.[2] ..... E21B 43/25; E21B 43/26
[58] Field of Search ..... 166/249, 299, 308, 63, 166/177, 259, 271

[56] References Cited

UNITED STATES PATENTS

| | | | |
|---|---|---|---|
| 2,871,943 | 2/1959 | Bodine, Jr. | 166/177 X |
| 3,151,679 | 10/1964 | Karpovich et al. | 166/299 |
| 3,174,561 | 3/1965 | Sterrett | 166/299 X |
| 3,367,442 | 2/1968 | Setser | 166/299 X |
| 3,520,362 | 7/1970 | Galle | 166/249 |
| 3,730,269 | 5/1973 | Galle | 166/177 |
| 3,743,017 | 7/1973 | Fast et al. | 166/249 |
| 3,842,907 | 10/1974 | Baker et al. | 166/249 |
| 3,850,135 | 11/1974 | Galle | 166/249 X |

*Primary Examiner*—Stephen J. Novosad
*Assistant Examiner*—George A. Suckfield

[57] ABSTRACT

This invention relates generally to petroleum well treatment and more particularly to improvement of production from earthen petroleum reservoirs of low permeability by fracturing the petroleum bearing strata. The present invention accomplishes this purpose by use of energy capsules that upon implosion produce acoustic waves as to cause the formation to undergo periodic stress beyond its elastic endurance limit and to fail by elastic fatigue.

A plurality of energy capsules designed to implode at different hydrostatic pressures in order to release shock waves to produce a cavitational action in the areas adjacent to the well bore are transmitted in a fluid medium. The energy capsules may be utilized in conjunction with pressurized fluid that is oscillated such that the combined elements of a pressurized fluid system and the release of shock waves at spaced time intervals from the energy capsules is obtained.

64 Claims, 4 Drawing Figures

METHOD AND SYSTEM FOR ULTRASONIC OIL RECOVERY

BACKGROUND OF THE INVENTION

1. Field of the Invention

This invention relates in general to well fracturing, and in particular to the use of capsules contained in a fluid and designed to implode at selected hydrostatic pressures in order to release acoustical energy waves in the fluid in a well bore to obtain fractures in the oil bearing formations.

2. Description of the Prior Art

The prior art broadly includes two well fracturing methods and apparatus utilized to obtain the fracturing of underground oil bearing formations.

One form of the prior art utilizes fluidic oscillators connected remotely if desired with the output of a fluid pump to generate pressure fluctuations that are acoustically coupled with a selected zone in a well bore. This concept is disclosed in a number of U.S. Patents issued to Albert G. Bodine, several of which are listed below.

| | | |
|---|---|---|
| 1. | 2,680,485 | Apparatus for Augmenting the Flow of Oil From Pumped Wells |
| 2. | 2,700,422 | Sonic System for Augmenting the Extraction of Petroleum From Petroleum Bearing Strata |
| 3. | 2,871,943 | Petroleum Well Treatment by High Power Acoustic Waves to Fracture the Producing Formation |
| 4. | 3,016,095 | Sonic Apparatus for Fracturing Petroleum Formation |
| 5. | 3,322,196 | Electro-Acoustic Transducer and Process for Using Same for Secondary Recovery of Petroleum From Wells |
| 6. | 3,578,081 | Sonic Method and Apparatus for Augmenting the Flow of Oil From Oil Bearing Strata. |

The above enumerated patents require the transmission of acoustical wave energy generally through a fluid medium to remote areas of the well in order to obtain the desired fracturing of the underground oil bearing formation.

The other form of system disclosed in the prior art employs well fracturing methods and apparatus whereby pressure fluctuations are generated in a well bore by pumping fluid through a first conduit to drive an acoustical oscillator coupled with an acoustical compliance that transmits the pressure fluctuations to a formation of the earth in a selected zone of the well bore. The well bore, which functions as a second conduit that contains the first conduit and the oscillator, returns fluid flow back toward a pump means. A variable restriction means such as a valve is used to adjust the back pressure in the well bore such that the maximum oscillated fluid pressure exceeds that pressure required for formation fracture. To achieve fracture only in the selected zone, acoustical isolation means are spaced above and below the acoustical oscillator to confine the pressure fluctuations to that zone. Also, the density of the fluid circulated in the well bore may be selectively varied to achieve fracture in the selected zone. This is illustrated in the patent listed below.

| | | |
|---|---|---|
| 7. | 3,842,907 | Acoustic Methods for Fracturing Selected Zones in a Well Bore |

SUMMARY OF THE INVENTION

The present invention in contrast to the prior art utilizes certain phenomena inherent in the above two areas discussed in order to increase the recovery of petroleum from an oil bearing formation. Utilization is made of energy capsules or chambers that are introduced within a fluid medium and pumped to the area that the breakthrough is required in order to obtain a flow of the oil from its enclosed position beneath the surface of the earth.

The limitations of the Bodine process is inherent in the fact that the energy can not always be transmitted to the exact location. Further, due to the fact of the absorbtion of the energy waves the radius of the horizontal distance from the well bore itself to the surrounding area in order to obtain the fracturing to produce new drainage channels to the well is limited.

With respect to the acoustic method of fracturing in which fluid is pumped through the well in order to obtain the pressure fluctuations as disclosed in U.S. Pat. No. 3,842,907, once again the limitations as to the distance that the energy may be transmitted is further encountered.

What the inventor has discovered is a new procedure for transmitting the desired energy to the requisite area in a simplified manner by the utilization of the physical characteristics obtained when cavitational energy is obtained at predetermined hydrostatic pressures. The inventor's discovery is that it is possible to substitute, in effect, capsules or chambers which act as individual energy radiators selected to collapse under preselected pressurization such that when the threshold occurs there is an implosion of the capsule and due to the violence of collapse there is released a series of shock waves which can be transmitted through the fluid medium in which they are supported or carried. The term "cavitation" is used herein to denote the release of energy waves in the equivalent sense of a bubble which implodes when cavitational action takes place and upon the implosion there is a scattering and dissipation of the energy in the surrounding medium. Accordingly, the inventor thereby utilizes the powerful agent capable of producing effects unattainable by other means when cavitation gas bubbles are formed within a location on a continuous basis.

The prior art systems, discussed above, require either continuous pulsations of the fluid or acoustic wave energy being transmitted therethrough. It can be well appreciated that due to the inherent size of the crevices and channels that a substantial portion of this energy is damped out and may never reach its ultimate desired goal with the force necessary to obtain maximum results. By the use of energy capsules, which may vary in size from approximately one-eighth inch in diameter to up to approximately 1 foot in diameter, and varied in a manner such that due to the thickness of the skin, or the selection of the material from which the skin or shell is made, that may implode at different pressures, a continuous release of energy waves may be released.

This permits the introduction within the fluid medium of a continuous precalculated array of capsules each selected to implode at different hydrostatic pressures such that there may be a continuous release of energy waves. Variations in the size of the capsules permit further the control as to the locations in which it is desired to reach certain selected areas. For example, if the radial distance from the well bore is desired to be worked, then the capsules may be selected in an initial diameter range. Then as one desires to move further out from the well bore the capsules of a smaller diameter range may be utilized to reach into smaller crevices of the oil bearing formation.

The energy capsules may be used in conjunction with pressurized fluid not only to obtain the hydrostatic pressure to affect the implosion of the capsules but also that of oscillating the pressure in the fluid within the well bore to further enhance the fracturing of the surrounding oil bearing formation. In a similar manner the energy capsules may be imploded by acoustic wave energy and the desired results obtained by the combination of the effects of the combined processes.

By way of additional background information, an oil reservoir in the ground is simply a region of porous oil-soaked rock or sand. Formation porosity refers to the total volume of voids in which oil may accumulate. Permeability refers to the ability of the formation to permit oil flow therethrough. Small pore size, and especially the absence of good joining channels between pores or voids, results in low permeability. Permeability largely determines the daily oil production rate of the well, and to a considerable degree determines how long the well will have a reasonable daily production.

A great many attempts have been made to increase artificially the production rate from a low permeability formation around a well bore. The present invention utilizes the energy capsules to enhance and obtain the dispersion of high intensity acoustic waves to fracture low permeability rock, provide new exposure area, and open up new drainage channels to the well.

Rock material will of course transmit acoustic (elastic) waves, and will continue to do so indefinitely at ordinary wave amplitudes, such as are set up with certain prior processes used for various purposes. In such elastic wave transmission, alternating deformation waves of compression and expansion travel through the rock. By utilization of the time capsules a series of shock waves is introduced into all the interstices not generally reachable, such that alternating deformation waves are produced to a certain threshold level, and under such conditions fatigue failure and resulting cracking of the rock occurs within a finite time period. The size and deformation pressure levels of the time capsules may be programmed that there is a threshold value of acoustic wave pressure amplitude for any given rock and set of local conditions surrounding the same, at which the rock is stressed beyond its strength or endurance limit, and if the wave is maintained at such amplitude, fatigue failure and fracturing will ensue. Beyond such threshold value fatigue failure occurs more promptly with higher and higher wave amplitudes. Accordingly, acoustic waves may be established in the formation by the energy capsules at or above a certain threshold value and place the rock media under more cyclic stress than its physical cohesive properties or tensile strength can endure, sometimes referred to as overstressing the rock, and that under such conditions the rock proceeds to fracture by the process of fatigue failure. It will further be understood that the expression "acoustic" is used herein in its technical meaning as understood by those skilled in the art, without implied limitation to the audible frequency range.

Sedimentary rocks are made up of successive relatively thick beds or strata of differing composition, such as sandstone, sand, clay, shale, limestone, etc. These thick beds usually reveal a large number of bedding planes. Thus a given bed, e.g., a sandstone, will ordinarily be composed of successive layers laid down under differing conditions, often separated by bands of clay, shale, or other material. The boundaries between successive beds of differing composition constitute planes of easiest separation, along which cracks or fractures may sometimes develop naturally, and which are not easily opened up by various so-called fracturing procedures. The successive layers are kept normally under high compression by the weight of the over burden. An aim of the present invention is to periodically elastically move or "work" these highly compressed and initially bonded layers, causing them to "fracture" and/or separate by subjecting them to extreme periodic elastic deformation stresses under the influence of powerful acoustic waves transmitted to and through them by releasing acoustic waves in energy transmission relationship thereto by the capsules. The fracturing can take place in either or both of two ways, first, separation and relative displacement of adjacent beds or layers, which of course means fracture of the bond between adjacent layers, and second fracturing of homogeneous beds by cyclic overstress of the formation to the point of fatigue failure. The acoustic waves may, in such manner, also result in vertical cracks due to the stress geometry of the beds or layers.

According to the invention, the acoustic waves are transmitted from a plurality of sonic wave radiators in the form of the self imploding capsules and via a body of coupling liquid maintained in the well bore, preferably under a suitable hydraulic pressure, transmitted to the areas that are capable of receiving the energy capsules therein. The coupling liquid contains the plurality time capsules and enters all available cracks, fissures and fractures therein, so as to provide a liquid wave transmission medium between the imploding capsules or radiators and all exposed surfaces of the formation. This coupling liquid has a specific acoustic impedance $pc$ (where $p$ is density and $c$ is the velocity of sound) which, while not as high as that of the formation, is nevertheless high enough that a large percentage of the wave energy transmitted through it to the formation is transmitted on into the formation. Some of the wave energy is of course reflected at the surface of the formation. At this reflecting boundary, a stress or pressure cycle is set up, acting to periodically move or reciprocate the surface of the formation through a definite displacement amplitude. Such cyclic movement of a bounding surface of the formation launches alternating elastic deformation waves which are propagated on through the formation with the speed of sound. Assuming a cyclic stress of sufficient magnitude at the point of incidence of the acoustic wave on the formation, and/or waves transmitted in the rock which are of sufficient magnitude to cyclically overstress the rock, the rock material is subject to fatigue failure occurring at the boundary planes between adjacent strata, with consequent loosening and separation of strata also produced.

The advantage of having different energy capsules is to obtain a series of shock waves that continue to occur such that if several hundred or several million are used we have a continuous energy front that feeds on itself as the initial cracks appear. For example, the characteristic acoustic impedance of sedimentary rock has a market discontinuity at the boundary planes between different strata, and at such planes, therefore, acoustic waves in the formation are substantially reflected rather than being fully transmitted into the adjacent strata. Accordingly, a given stratum within which a powerful sound wave is being propagated will undergo cyclic elastic deformation movements relative to adjacent strata, thus creating cyclic forces between strata which exceed the strength of the bond therebetween, thereby causing fractures along these planes. Also, assuming the case of waves set up in two adjacent strata of different acoustic impedance, the waves will travel at differing velocities, and the resulting phase difference on opposite sides of the bounding plane results in cyclic shearing forces which exceed the strength of the bond between the strata and thereby cause fracture or separation.

With respect to the above-mentioned acoustic coupling liquid, in which the energy capsules are suspended, it is very important that contact with the formation to be fractured be attained and that the liquid be made to follow up changes in geometry as fractures are generated, because the transmission of acoustic fracturing energy to the formation depends upon the presence of the liquid body. It is generally desirable to the accomplishment of this function that the coupling liquid be maintained under a considerable hydraulic head. The necessary pressure can often be attained by the hydrostatic head of a column of liquid filling the well hole to the ground surface. If such hydrostatic head proves to be inadequate, additional pressure can be applied by means of a suitable pressure source at the ground surface.

Assuming a hydrostatic head on the coupling liquid, as described, pressure waves may be radiated into the liquid by the coupling liquid alone and in combination with the energy capsules, and it will be seen that this pressure wave will be superimposed on, i.e., will comprise alternative positive and negative pressure half cycles relative to, maintained mean hydrostatic pressure, and the various pressures designed into the energy capsules. Maintenance of the coupling fluid under hydraulic pressure, as mentioned above, is also important from an acoustic standpoint, since the higher the mean pressure of the coupling liquid, the greater will be the amplitude of the acoustic waves transmitted through the liquid and the force for carrying the time capsules into the crevices of the earth's formation. The sound wave is thus transmitted to the exposed wall surface of the formation, to be thence propagated through the formation. Within the formation, the sound wave involves alternate positive and negative pressure cycles relative to the compressive pressure normally existing within the formation owing to the overburden. Within the coupling liquid and at the formation wall surface, this amplitude of energy waves is that which will elastically vibrate the formation sufficiently to overstress it and cause it to fail by elastic fatigue. Within the formation, this amplitude is that which is sufficient to overstress the formation and cause it to fail or fracture by elastic fatigue. Thus, the acoustic waves impinging upon and/or transmitted through the formation subject the formation to a cyclic elastic stress, and when this stress is of sufficient magnitude, the rock is cyclically stressed beyond its fatigue strength at a frequency of many times per second, and fails or factures as the inevitable consequence.

OBJECTS OF THE INVENTION

An object of the present invention is the provision of a simple system of fracturing of underground oil bearing formations, by introducing energy capsules within a fluid medium and transmitting them to the relative locations and by the implosion of the energy capsules at selected hydrostatic pressures to thereby release sonic waves through the formation desired to be fractured to form openings to release the entrapped oil.

Another object of the invention is to increase materially the acoustic energy delivered to the formation particularly in depleted wells which tend to make acoustic coupling difficult by the utilization of energy capsules designed to implode and transmit shock waves through the fluid medium the energy capsules are suspended in.

Another object is to provide an acoustic wave radiation pattern by varying the hydrostatic pressure or force required to obtain an implosion of the energy capsules at various levels.

Another object of the invention is to provide a system which maintains an assured hydrostatic head of well fluid, to the end that large amounts of sonic energy can be radiated from the energy capsules by the release of cavitational energy.

Another object of the invention is to provide conditions and a process according to which, a plurality of energy capsules are designed to implode to provide a large radiation surface.

Another object of the invention is to provide a method and apparatus for utilizing a deep well pump, or an auxiliary apparatus associated with a deep well pump, in conjunction with energy capsules contained in a fluid medium, for producing wave energy into the formation for the purpose of augmenting the rate of migration of well fluids from the formation to the well.

Another object of the present invention is the provision of a method and apparatus involving the application of high intensity acoustic waves to fracture low permeability rock, provide new exposure area, and open up new drainage channels to well.

Other objects of the invention will become apparent as the disclosure proceeds.

BRIEF DESCRIPTIONS OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

Figure 3:
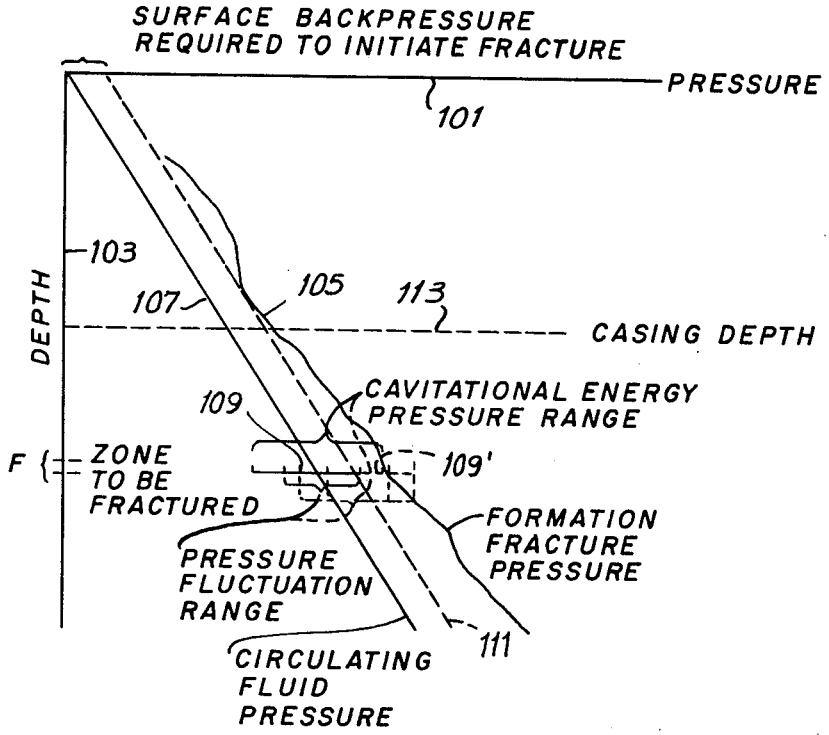
Figure 4:
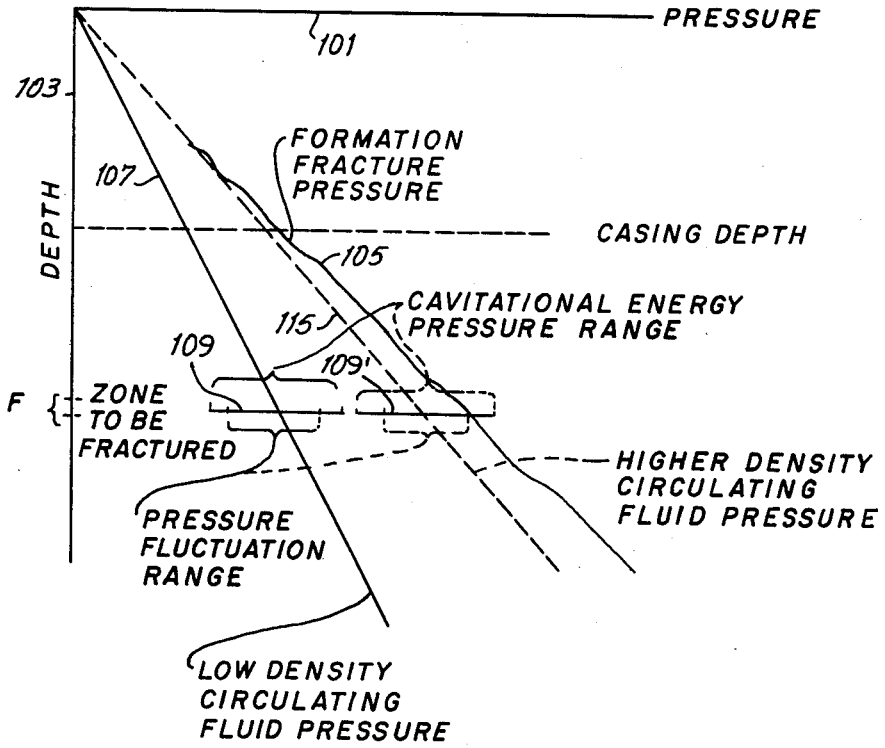

FIG. 3 is a graph showing the variation with depth of the hydrostatic pressure in a well bore, the result when back pressure is increased in the fluid returning from the well bore, and the change in pressure is acoustically fluctuated and cavitational energy released; and FIG. 4 is a graph, which shows the variation with depth of the hydrostatic pressure in a well bore, the result if the density of fluid in the well bore is varied, and the change in pressure if acoustically fluctuated and cavitational energy released.

DETAILED DESCRIPTION OF THE DRAWINGS

It is understood and appreciated that the primary aim of the invention is to deliver the energy capsules to the proximity of the oil bearing formation in a fluid medium for increasing recovery of petroleum. If desired, the energy released may be coupled with acoustic vibrations as set forth and generated in accordance with the teachings of U.S. Pat. No. 3,842,907 or other known means for obtaining same.

Accordingly, the system for the recovery of petroleum from an oil bearing formation may have certain design features as set forth in U.S. Pat. No. 3,842,907, referred to above, and the subject matter thereof incorporated herein, for generating acoustic vibrations in a well bore, for coupling these vibrations to the zone to be fractured, for isolating the vibrations to the selected zone, and for controlling the average fluid pressure in the well bore adjacent a zone to be fractured. The peak-to-peak amplitude of the pressure variations may be in the range from approximately 200 to 5,000 p.s.i., and the energy capsules designed to collapse in this pressure range.

Figure 1:
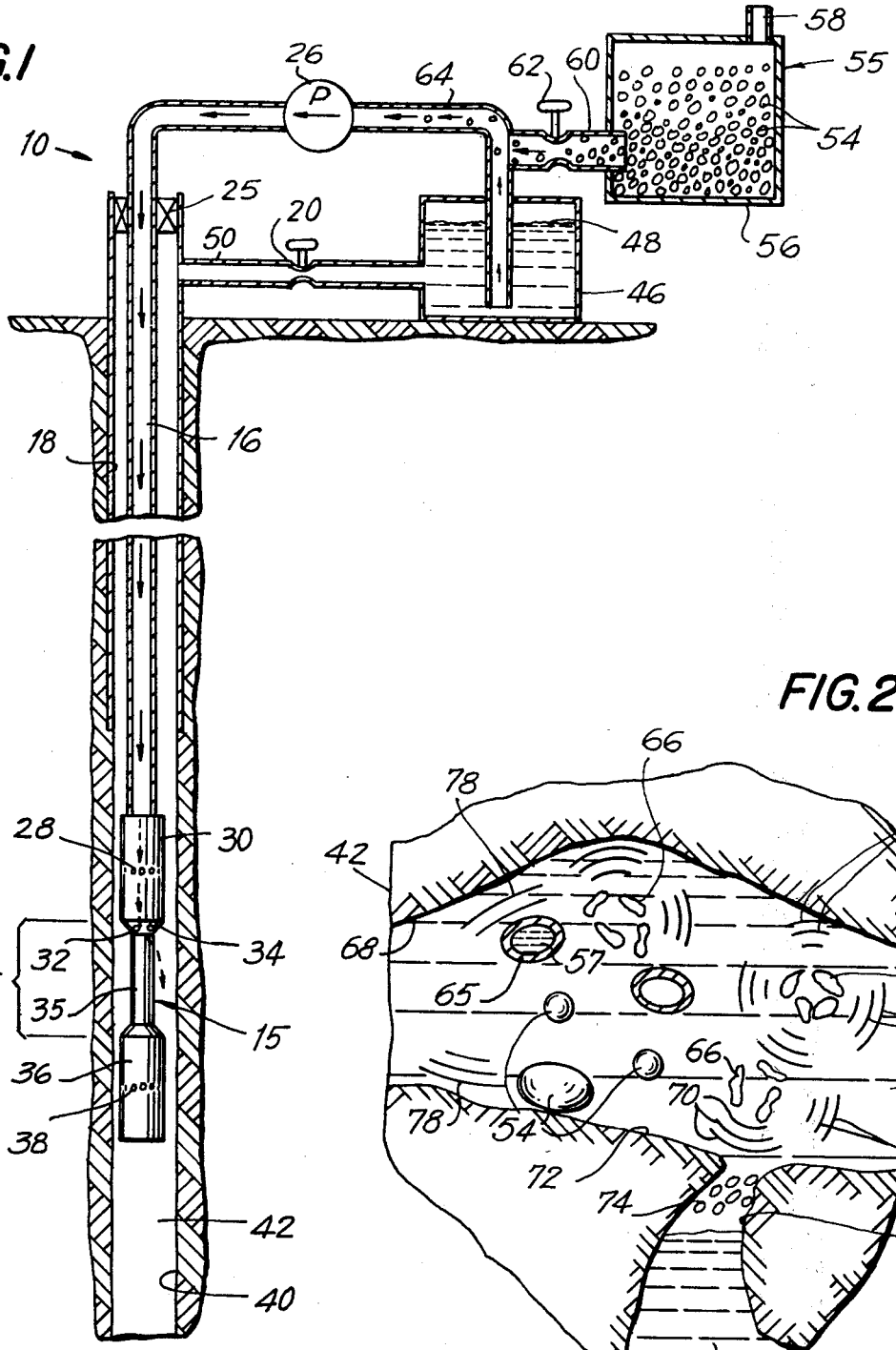
FIG. 1 is a side elevational view illustrating schematically the system to accomplish the objects of the invention.

With reference initially to FIG. 1 of the drawings, the system 10 may include an acoustic vibration generator means 15, in energy transmission relationship to the oil bearing formation which includes an oscillator unit for a coupling device that communicates with fluid adjacent a mineral producing region or zone F (see FIG. 3) to be fractured in a well bore. An upper resonator or acoustical filter is disposed above the generator means 15 assembly, and a lower resonator or acoustical filter is disposed beneath the generator assembly 15. The apparatus described thusfar is supported by a first conduit or tubing string 16 in energy transmission relationship to the oil bearing formation, disposed inside a second conduit or well casing 18 of a well bore 18 forming a portion of a fluid flow return line containing a variable flow restriction means such as the valve 20 which returns fluid to a fluid reservoir 46. Seal means 25 between the first and second conduits, 16 and 18, prevents loss of fluid from the pump means 26 which supplied the first conduit 16, the fluid oscillator unit, and coupling device.

Housing means 30 of the generator assembly 15 contains the acoustic coupling device and the oscillator unit, both of which may be of the type described in U.S. Pat. No. 3,405,770, "Drilling Methods and Apparatus Employing Pressure Variations in a Drilling Fluid," issued Oct. 15, 1968. As described in that patent, the coupling device is tuned to the operating frequency of the oscillator unit, and has one or more exit ports 32 extending through exterior surface 34 of housing 30 into communication with the fluid surrounding a small diameter section 35.

The invention is not limited to the specific forms of oscillators and coupling devices described in the above mentioned patent, but encompasses, at least in its broadest aspects, other suitable forms of oscillator units and coupling devices. Although the above fluidic (i.e., containing no moving mechanical components) devices appear to have advantages since they eliminate moving mechanical parts, magnetostrictive and piezoelectric transducers may also be utilized for the transmission of energy to the oil bearing formation. The frequency of acoustic vibrations may be in the sonic or ultrasonic range from substantially 50 to 100,000 cycles per second. Applicant wishes to point out that under certain circumstances it may only be necessary, or desirable to employ energy capsules to generate the cavitational energy to increase the petroleum recovery, and that no oscillators be used.

The upper resonator has outlet ports 28. The lower region of the housing 30 of the generator assembly has a continuation of the small diameter region 35 which has its lower region secured to the housing 36 which contains lower resonator or filter which is one form of acoustic vibration isolator means having outlet parts 38. An axial bore (not shown) extends downward through the upper resonator in housing 30, section 35 including generator assembly 15.

The volume of fluid between the wall 40 of the bore hole 42 in which the exterior surface of section 35 and the small diameter regions of housing 30 and 36 defines an exterior tank or compliance 45 opposite the region, medium or zone to receive acoustic vibrations, said compliance 45 having dimensions correlated with the dimensions of the apertures 32 and the cavity of the coupling device to couple the oscillator unit with the acoustic load.

The axial bore (not shown) within the housing 30 is an extension of the first conduit 16 which receives fluid from the pump means 26 connected with the fluid reservoir means 46 containing fluid 48. The first conduit 16 extends inside a second conduit 18, which is sealed from the first conduit by the seal means 25. The fluid line 50 extends from the second conduit 18 and forms a part of a fluid flow return line to the reservoir 46, that includes a variable flow restriction means 20, which in this instance is a valve that may be opened or closed to control the static pressure in the system. Thus, by opening or closing the valve, selective control is maintained over the average pressure in the fluid return line, over the average pressure in the acoustical compliance, and over the pressure drop across the acoustical oscillator.

The acoustic vibration generator assembly 15 includes a "fluidic" oscillator in that it has no moving mechanical components. It is a high gain, bi-stable fluidic amplifier with positive feedback to cause oscillation of the bi-stable unit. The coupling device couples the output of the acoustic vibration oscillator with the drilling fluid located in the acoustic compliance, cavity or tank 45.

In operation pump 26 is activated to draw fluid 48 from the fluid reservoir 46 and force it under pressure through the tubing string or first conduit 16, located partially inside the well casing or second conduit 18, which contains at a selected location the acoustic vibration generator assembly 15 and acoustic compliance 45 opposite region zone F of the formation to be fractured. Fluid therefore flows from the tubing string 16 into the axial opening to feed the oscillator unit which generates acoustic energy. This acoustic energy is transmitted by the acoustic coupling device and the exit ports 32 into the acoustic tank or compliance 45.

Fluid then returns to the surface of the well bore in the annulus of the well bore. Consequently, acoustic energy is transmitted to the earth. The previously described acoustic energy isolation means or acoustic filters or resonators prevent the dissipation of substantial quantities of acoustic energy upward or downward in the annulus. The length of zone F in FIG. 3 may be varied by inserting different lengths of sections 35 between the housing 30 of the generator assembly 15 and the housing 36 of the lower resonator to vary the length of the acoustically treated zone. Acoustic energy will normally travel both upward and downward through the well bore 42 but is effectively prevented from doing so in this instance by the use of the isolator means. The resonators are used as side branches with inlets at points one quarter wave length above and below acoustic tank 45. This effectively causes the acoustic impedance looking into the annulus from acoustic tank 45 to be very high, thus preventing substantial transmission of acoustical power either up or down the annulus.

Fluid flow returns up the annulus between the tubing string or first conduit 16 and the well casing or second conduit 18 toward the pump 26. The seal 25, which may be in the form of a conventional blow-out preventer pipe ram, is inserted between the first and second conduits 16 and 18 to cause fluid to return to the variable flow restriction means, in this instance valve 20 located in the return line 50. By varying the setting of this valve, the back pressure in the acoustic circuit and in the well bore may be maintained at a selected average pressure. Further, if peak-to-peak pressure amplitudes of 1,500 p.s.i. are to be utilized, for example, the average static back pressure in the vicinity of oscillator should be at least 1,500 p.s.i. and preferably somewhat above this figure or otherwise the desired peak-to-peak pressure variations cannot be obtained.

Figure 2:
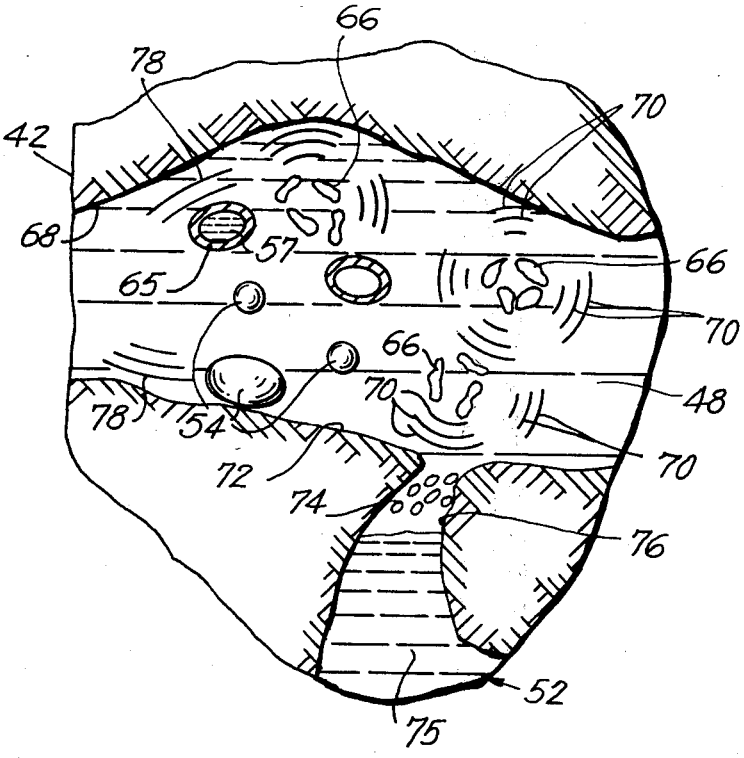
FIG. 2 is an enlarged diagrammatic fragmentary view to illustrate the process in which energy is released upon the collapse of the capsules.

In accordance with the present invention, the system 10 for increasing the recovery of petroleum from an oil bearing formation 52 diagrammatically illustrated in FIG. 2 includes a plurality of energy capsules 54. Means 55 for introducing the energy capsules 54 within the fluid 48 is provided in the form of storage means, which may be a tank having an inlet opening 58 through which the energy capsules 54 may be continuously provided. Outlet means 60 extends from the storage means 56 and is coupled to the conduit 64 that connects the reservoir 46 to the pump means 26. The valve 62 controls the rate of flow of the energy capsules 54 within the fluid 48 as it is removed from the reservoir 46.

The size of the energy capsules 54 may vary in size and have cross-sectional areas in the range of from ⅛ in. to 1 ft. and have a spherical shape or configuration. The wall 65 (see FIG. 2) may be varied in thickness to obtain the collapse thereof at different hydrostatic pressures. The energy capsule 54 may be constructed of plastic or metallic materials or combinations thereof and in the wall thickness and shape desired to obtain the necessary cavitational energy released upon their collapse. In this manner the energy capsule 54 is carried in the fluid 48. The energy capsule 54 may have a fluid 57 contained therein or be in a complete or partial vacuum.

As seen in FIG. 2, the bore wall 40 has an opening 68 into which the fluid 48 and energy capsules 54 flow in proximity to the oil bearing formation 52. The energy capsule 54 automatically implodes when a certain hydrostatic pressure is obtained and the fragments 66 remain in the fluid and the shock waves 70 are transmitted to the surrounding earth through the fluid medium 48. In this manner the earthen formation at the inner wall 72 of the opening or crevice 68 is fragmented into particles 74 thereby exposing the oil 75 and providing a channel 76 for a release of the oil 75 through the opening 68 and bore wall 40 and up through the bore hole 42.

In addition the cavitational energy released into the fluid 48 by the collapse of the capsule 54, illustrated as waves 70, may be coupled with the shock waves generally by the oscillator means 15 illustrated in FIG. 1. Accordingly, shock or energy waves 78 of the oscillator means 15 may act in combination with the energy released by the capsule 54. The acoustic energy waves 78 act to fragment the oil bearing strata in such a manner to expose the oil 75 to permit its release.

According to the invention, as illustrated in FIG. 2, the acoustic waves 70 are transmitted from a plurality of sonic wave radiators in the form of the self imploding capsules 54 and via a body of coupling liquid 48 maintained in the well bore 42, preferably under a suitable hydraulic pressure, transmitted to the areas that are capable of receiving the energy capsules 54 therein. The coupling liquid 48 contains the plurality of time capsules 54 and enters all available cracks, fissures and fractures 68 therein, so as to provide a liquid wave transmission medium between the imploding capsules or radiators 54 and all exposed surfaces of the formation 52.

The advantage of having different energy capsules 54 is to obtain a series of shock waves 70 that continue to occur such that if several hundred or several million are used we have a continuous energy front that feeds on itself as the initial cracks appear. For example, the characteristic acoustic impedance of sedimentary rock has a marked discontinuity at the boundary planes between different strata, and at such planes, therefore, acoustic waves in the formation are substantially reflected rather than being fully transmitted into the adjacent strata. Accordingly, a given stratum within which a powerful sound wave is being propagated will undergo cyclic elastic deformation movements relative to adjacent strata, thus creating cyclic forces between strata which exceed the strength of the bond therebetween, thereby causing fractures along these planes. Also, assuming the cause of waves set up in two adjacent strata of different acoustic impedance, the waves will travel at differing velocities, and the resulting phase difference on opposite sides of the bounding plane results in cyclic shearing forces which exceed the strength of the bond between the strata and thereby cause fracture or separation.

With respect to the above-mentioned acoustic coupling liquid, in which the energy capsules 54 are suspended, it is very important that contact with the formation to be fractured be attained and that the liquid 48 be made to follow up changes in geometry as fractures are generated, because the transmission of acoustic fracturing energy to the formation depends upon the pressence of the liquid body. It is generally desirable to the accomplishment of this function that the coupling liquid 48 be maintained under a considerable hydraulic head. The necessary pressure can often be attained by the hydrostatic head of a column of liquid filling the well hole 42 to the ground surface. If such hydrostatic head proves to be inadequate, additional pressure can be applied by means of a suitable pressure source at the ground surface in accordance with the system illustrated in FIG. 1.

Assuming a hydrostatic head on the coupling liquid 48, as described, pressure waves 78 may be radiated into the liquid by the coupling liquid 48 alone and in combination with the energy capsules 54, and it will be seen that this pressure wave 78 will be superimposed on, i.e., will comprise alternative positive and negative pressure half cycles relative to, the maintained mean hydrostatic pressure, and the various pressures designed into the energy capsules.

Maintenance of the coupling fluid 48 under hydraulic pressure, as mentioned above, is also important from an acoustic standpoint, since the higher the mean pressure of the coupling liquid 48, the greater will be the amplitude of the acoustic waves transmitted through the liquid and the force for carrying the time capsules 54 into the crevices 76 of the earth formation 52. The sound wave 70 is thus transmitted to the exposed wall surface 72 of the formation 52, to be thence propagated through the formation 52. Within the formation 52, the sound wave 70 involves alternate positive and negative pressure cycles relative to the compressive pressure normally existing within the formation 52 owing to the overburden. Within the coupling liquid 48 and at the formation wall surface 72, this amplitude of energy waves 70 and 78 is that which will elastically vibrate the formation 52 sufficiently to overstress it and cause it to fail by elastic fatigue to create particles 74. Within the formation 52, this amplitude is that which is sufficient to overstress the formation 52 and cause it to fail or fracture by elastic fatigue. Thus, the acoustic waves impinging upon and/or transmitted through the formation subject the formation to a cyclic elastic stress, and when this stress is of sufficient magnitude, the formation is cyclically stressed beyond its fatigue strength at a frequency of many times per second, and fails or fractures as the inevitable consequence.

The beneficial effects achieved by the invention as a well fracturing method and apparatus is demonstrated in FIG. 3 wherein the numeral 101 represents the abscissa of a graph designating the pressure of the fluid in a well bore. The numeral 103 represents the ordinate of this graph upon which is shown the depth of a well bore. The line designated by the numeral 105 is a plot of the pressure required to initiate a fracture in the well bore. This formation fracture pressure generally increases with depth.

The energy capsules 54 carried in the fluid medium permit an increase in the amount of useable energy that may be transmitted to the oil bearing formation. As is illustrated, the cavitational pressure range in FIG. 3 and in FIG. 4 is increased by the present method and apparatus of deploying the energy capsules throughout the fluid with the subsequent release of cavitational energy to increase the pressure as compared to only utilizing acoustical wave energy.

In the graph of FIG. 3, the numeral 107 designates a line representing the pressure of the fluid circulating through the well bore and shows how this pressure increases with depth in the well bore. When using the invention, the actual range of pressures existing in the fluid adjacent a zone to be fractured is indicated by the short horizontal line 109, which represents the peak-to-peak pressure fluctuation range produced by the acoustic vibration generator assembly previously described. The resulting pressure fluctuations cause the pressure to vary equally above and below line 107. The zone to be fractured is indicated by the letter F on the ordinate 103. Since the sum of the circulating fluid pressure and the fluctuating pressure at this depth is less than the formation fracture pressure, fracturing will not occur. Increasing the back pressure on the system through adjustment of the valve means or variable flow restriction means 20 increases the pressures throughout the system uniformly, shifting the line 109 to the right. Back pressure in the system is increased slowly until the pressure of the circulating fluid assumes the position indicated by the dashed line 111 of the graph. As shown, the maximum pressure achieved through addition of the circulating pressure and the peak positive pressures achieved with fluctuations of the oscillator is now equal to the formation fracture pressure depicted by the line 105. Hence, fracturing can occur. Since the pressure fluctuations are isolated to the region of zone F by the previously described isolation means, at zone F fluid pressures are great enough to induce fractures. Otherwise, fracture might occur between the depths represented by the lines 109 and 113. Line 113 represents the depth that casing has been set in the particular well under consideration.

In FIG. 4 are shown the same abscissa 101, pressure ordinate 103, depth, and the zone F where the formation is to be fractured. Line 107 represents the fluid pressure when plotted against depth, and the line 109 represents the range of the pressure fluctuations generated by the oscillator. Also, the line 105 represents formation fracture pressure plotted against depth. With a low density fluid, the maximum pressure at zone F may be less than the formation fracture pressure at that depth and fracturing will not occur, as indicated by the line 107 in FIG. 4. Increasing the density of the circulating fluid by the addition of weighting material to the mud will increase the fluid pressure as shown by the dashed line 115. Hence, fluid density may be increased until the sum of the circulating fluid pressure and the fluctuating pressure adjacent the zone to be fractured is large enough to induce fracture. This condition is represented by the intersection of line 109 with the formation fracture pressure line 105 shown in FIG. 4.

Increasing the back pressure and increasing the circulating fluid density may be combined to induce fractures in the formation. Generally, it is more economical to use higher back pressure than increased circulating fluid density to initiate fracture. However, caution must be exercised not to increase back pressure to the point of initiating a fracture outside of zone F immediately below the casing, as for example, when the formation back pressure is increased until it is greater than the formation fracture pressure immediately below the casing. Thus by properly combining selected back pressures and fluid densities, fracture initiations may be confined to a selected zone.

While FIGS. 3 and 4 indicate that the zones to be fractured are below the bottom of the casing, it should be understood that the invention is not restricted to use in open formations. It may be used to fracture formations through perforations in a casing.

It should be apparent from the foregoing that an invention has been provided having significant advantages. Through alteration and control the back pressure of the circulating fluid in a well bore and/or by controlling and adjusting the density of this fluid, fractures may be located in a selected zone through utilization of apparatus of the type previously described.

While the invention has been described in only one of its forms, it should be apparent to those skilled in the art that it is not so limited but is susceptible to various changes and modifications without departing from the spirit thereof. The specific forms of the apparatus such as for example the oscillator, the coupling device, the connecting conduits, the variable restriction means and the pump means may be varied widely by those of average skill in the art to accomplish the objects and advantages of the invention.

I claim:

1. The process for increasing the recovery of petroleum from an oil bearing formation remote from a well bore comprising the steps of:

A. pumping a fluid down a well bore through a conduit adjacent to the oil bearing formation under sufficient pressure such that said fluid enters the fissures remote from the well bore, and B. introducing into said fluid a plurality of energy capsules so as to travel in said fluid for positionment within the fissures, and adapted to implode at one or more hydrostatic pressure levels for releasing energy in said fluid, whereby the continuously collapsing energy capsules in said fluid in the fissures transmit energy waves through said fluid to the surfaces of said oil bearing formation for producing separations therein for the release of oil from the formation.

2. The process as defined in claim 1, and further including the step of varying the size of said energy capsules.

3. The process as defined in claim 1, and further including the step of varying the size of said energy capsules having cross-sectional diameter in the range of from ⅛ in. to 1 ft.

4. The process as defined in claim 1, and further including the step of providing said energy capsules having a spherical shape.

5. The process as defined in claim 1, and further including the step of varying the wall thickness of said energy capsules to obtain the collapse thereof at different hydrostatic pressure levels.

6. The process as defined in claim 1, and further including the step of varying the hydrostatic pressure levels at which the energy capsules implode.

7. The process as defined in claim 1, and further including the step of providing said energy capsules of substantially vacuum form.

8. The process as defined in claim 1, and further including the step of oscillating the pressure in said fluid within the well bore to further enhance the fracturing of the surrounding oil bearing formation.

9. The process as defined in claim 8, and further including the step of coupling the resulting fluid pressure oscillations with the bore hole wall at a select depth.

10. The process as defined in claim 9, and further including the step of isolating the fluid pressure oscillations to a selected zone to be fractured.

11. The process as defined in claim 10, and further including the step of returning the fluid flow between the first conduit and a second conduit formed at least partially by the wall of the well bore.

12. The process as defined in claim 11, and further including the step of increasing the pressure of the fluid to control the fluid pressure in the well bore to initiate fracture in the selected zone.

13. The process as defined in claim 1, and further including the step of providing an output space to permit the exiting of the produced oil.

14. The process as defined in claim 13, and further including the step of providing an output space in relationship to the entrance of said fluid to permit the exiting of the produced oil.

15. The process as defined in claim 13, and further including the step of maintaining said fluid under pressure.

16. The process as defined in claim 15, and further including the step of oscillating the pressure in said fluid within the well bore to further enhance the fracturing of the surrounding oil bearing formation.

17. The process as defined in claim 16, and further including the step of coupling the resulting fluid pressure oscillations with the bore hole wall at a select depth.

18. The process as defined in claim 17, and further including the step of isolating the fluid pressure oscillations to a selected zone to be fractured.

19. The process as defined in claim 18, and further including the step of returning the fluid flow between the first conduit and a second conduit formed at least partially by the wall of the well bore.

20. The process as defined in claim 19 and further including the step of increasing the pressure of the fluid to control the fluid pressure in the well bore to initiate fracture in the selected zone.

21. The process for increasing the recovery of petroleum from an oil bearing formation remote from a well bore, comprising the steps of:

A. pumping a fluid down a well bore through a conduit adjacent to the oil bearing formation, B. maintaining said fluid under pressure, such that said fluid enters the fissures remote from the well bore, C. introducing into said fluid a plurality of energy capsules so as to travel in said fluid for positionment within the fissures, and adapted to implode at one or more hydrostatic pressure levels, and D. continuously collapsing said energy capsules in said fluid in the fissures to transmit energy waves through said fluid to the surfaces of said oil bearing formation for producing separations therein for the release of oil from the formation.

22. The process as defined in claim 21, and further including the step of varying the size of said energy capsules.

23. The process as defined in claim 21, and further including the step of varying the size of said energy capsules having cross-sectional diameter in the range of from ⅛ in. to 1 ft.

24. The process as defined in claim 21, and further including the step of providing said energy capsules having a spherical shape.

25. The process as defined in claim 21, and further including the step of varying the wall thickness of said energy capsules to obtain the collapse thereof at different hydrostatic pressure levels.

26. The process as defined in claim 21, and further including the step of varying the hydrostatic pressure levels at which the energy capsules implode.

27. The process as defined in claim 21, and further including the step of providing said energy capsules of substantially vacuum form.

28. The process for increasing the recovery of petroleum from an oil bearing formation remote from a well bore comprising the steps of:

A. pumping a fluid down a well bore through a conduit in the region of the oil bearing formation, B. maintaining said fluid under pressure in the range of from approximately 200 to 5,000 p.s.i. such that said fluid enters the fissures remote from the well bore, C. generating acoustic vibrations in the range from substantially 50 to 100,000 cycles per second in said fluid for transmission to the fissures remote from the well bore of said oil bearing formation, D. introducing into said fluid a plurality of energy capsules so as to travel in said fluid for positionment within the fissures, and adapted to implode at one or more hydrostatic pressure levels, and E. continuously collapsing said energy capsules in said pressure range to release cavitational energy in said fluid in the fissures to transmit energy waves through said fluid to the surfaces of said oil bearing formation for producing separations therein for the release of oil from the formation by the combined energy released from said energy capsules and the acoustic vibrations.

29. The process as defined in claim 28, and further including the step of transmitting said acoustic vibrations to the fluid adjacent the oil bearing formation region.

30. The process as defined in claim 28, and further including the step of isolating the acoustic vibrations to the oil bearing formation region.

31. The process as defined in claim 28, and further including the step of returning said fluid to the surface through an annular space external of said conduit.

32. The process as defined in claim 28, and further including the step of generating said acoustic vibrations fluidically.

33. The process as defined in claim 28, and further including the step of varying the size of said energy capsules.

34. The process as defined in claim 28, and further including the step of varying the size of said energy capsules having cross-sectional diameter in the range of from ⅛ in. to 1 ft.

35. The process as defined in claim 25, and further including the step providing said energy capsules having a spherical shape.

36. The process as defined in claim 28, and further including the step of varying the wall thickness of said energy capsules to obtain the collapse thereof at different hydrostatic pressure levels.

37. The process as defined in claim 28, and further including the step of varying the hydrostatic pressure levels at which the energy capsules implode.

38. The process as defined in claim 28, and further including the step of providing said energy capsules of substantially vacuum form.

39. The process as defined in claim 28, and further including the step of controlling the rate of introducing said energy capsules with the fluid.

40. The process for increasing the recovery of petroleum from an oil bearing formation remote from a well bore comprising the steps of:

A. pumping a fluid down a well bore through a conduit in the region of the oil bearing formation, B. maintaining said fluid under pressure, such that said fluid enters the fissures remote from the well bore, C. converting a portion of the energy of said fluid into acoustic vibrations, D. transmitting said acoustic vibrations to the fluid in the fissures of the oil bearing formation region, E. introducing into said fluid a plurality of energy capsules so as to travel in said fluid for positionment within the fissures adapted to implode at varying hydrostatic pressure levels, F. continuously collapsing said energy capsules to release cavitational energy capsules in said fluid in the fissures to transmit energy waves through said oil bearing formation for producing separations therein for the release of oil from the formation by the combined energy released from said energy capsules and the acoustic vibrations, and G. returning said fluid to the surface through a space external of said conduit.

41. The process as defined in claim 40, and further including the step of varying the wall thickness of said energy capsules to obtain the collapse thereof at different hydrostatic pressure levels.

42. The process as defined in claim 40, and further including the step of providing said energy capsules of substantially vacuum form.

43. The process as defined in claim 40, and further including the step of varying the size of said energy capsules having cross-sectional areas in the range of from ⅛ in. to 1 ft.

44. The system for increasing the recovery of petroleum from an oil bearing formation remote from a well bore comprising:

A. means for pumping a fluid down a well bore through a conduit in the region of the oil bearing formation under sufficient pressure such that said fluid enters the fissures remote from the well bore, B. a plurality of energy capsules of a size so as to travel in said fluid for positionment within the fissures, and adapted to implode at one or more hydrostatic pressure levels, and C. means for introducing into said fluid said capsules, wherein the continuously collapsing energy capsules in said fluid in said fissures transmit energy waves through said fluid to the surfaces of said oil bearing formation for producing separations therein for the release of oil from the formation.

45. The system as defined in claim 44, wherein said energy capsules vary in size.

46. The system as defined in claim 44, wherein said energy capsules have cross-sectional diameter that are in the range of from ⅛ in. to 1 ft.

47. The system as defined in claim 44, wherein said energy capsules have a spherical shape.

48. The system as defined in claim 44, wherein the wall thickness of said energy capsules vary to collapse at different hydrostatic pressure levels.

49. The system as defined in claim 44, wherein the hydrostatic pressure levels at which the energy capsules implode varies.

50. The system for increasing the recovery of petroleum from an oil bearing formation remote from a well bore comprising:

A. means for pumping a fluid down a well bore through a conduit and into energy transmission relationship to the oil bearing formation, B. means for maintaining said fluid under pressure, such that said fluid enters the fissures remote from the well bore, C. a plurality of energy capsules so as to travel in said fluid for positionment within the fissures, and adapted to implode at one or more hydrostatic pressure levels, and D. means for introducing into said fluid said plurality of energy capsules, wherein said energy capsules collapse to transmit energy waves through said oil bearing formation for producing separations therein for the release of oil from the formation.

51. The system as defined in claim 50, wherein said energy capsules vary in size.

52. The system as defined in claim 50, wherein said energy capsules have cross-section diameter that are in the range of from ⅛ in. to 1 ft.

53. The system as defined in claim 50, wherein said energy capsules have a spherical shape.

54. The system as defined in claim 50, wherein the wall thickness of said energy capsules vary to collapse at different hydrostatic pressure levels.

55. The system as defined in claim 50, wherein the hydrostatic pressure levels at which the energy capsules implode varies.

56. The system as defined in claim 50, wherein said energy capsules are of substantially vacuum form.

57. The system as defined in claim 50, and further including means for oscillating the pressure in said fluid within the well bore to further enhance the fracturing of the surrounding oil bearing formation.

58. The system as defined in claim 57, and further including means for coupling the resulting fluid pressure oscillations with the bore hole wall at a select depth.

59. The system as defined in claim 57, and further including means for isolating the fluid pressure oscillations to a selected zone to be fractured.

60. The system as defined in claim 57, and further including means for returning the fluid flow between the first conduit and a second conduit formed at least partially by the wall of the well bore.

61. The system as defined in claim 57, and further including means for increasing the pressure of the fluid to control the fluid pressure in the well bore to initiate fracture in the selected zone.

62. The system for increasing the recovery of petroleum from an oil bearing formation remote from a well bore comprising:

A. means for pumping a fluid down a well bore through a conduit and into energy transmission relationship of the region containing the oil bearing formation, B. means for maintaining said fluid under pressure, such that said fluid enters the fissures remote from the well bore, C. means for generating acoustic vibrations in said fluid, D. means for transmitting said acoustic vibrations to the fluid adjacent the oil bearing formation region, E. a plurality of energy capsules so as to travel in said fluid for positionment within the fissures, and adapted to implode at one or more hydrostatic pressure levels, F. means for introducing into said fluid said plurality of energy capsules, wherein said energy capsules continuously collapse to transmit energy waves through said oil bearing formation for producing separations therein for the release of oil from the formation by the combined energy released from said energy capsules and the acoustic vibrations, and G. means for returning said fluid to the surface through a space external of said conduit.

63. The system as defined in claim 62, wherein the wall thickness of said energy capsules vary to obtain the collapse thereof at different hydrostatic pressure levels.

64. The system as defined in claim 62, wherein cavitational energy is released upon the collapse of said capsules.

* * * * *